US008941701B2

(12) United States Patent
Hamada et al.

(10) Patent No.: US 8,941,701 B2
(45) Date of Patent: Jan. 27, 2015

(54) IMAGE FORMING APPARATUS AND METHOD FOR CONTROLLING THE IMAGE FORMING APPARATUS

(75) Inventors: Takatoshi Hamada, Toyokawa (JP); Yohei Yamada, Toyokawa (JP); Yasuomi Mitsui, Toyokawa (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 382 days.

(21) Appl. No.: 13/530,983

(22) Filed: Jun. 22, 2012

(65) Prior Publication Data

US 2013/0010045 A1 Jan. 10, 2013

(30) Foreign Application Priority Data

Jul. 7, 2011 (JP) ..... 2011-150907

(51) Int. Cl.

| | |
|---|---|
| ***B41J 2/385*** | (2006.01) |
| ***B41J 27/00*** | (2006.01) |
| ***G03G 15/04*** | (2006.01) |
| ***G03G 21/20*** | (2006.01) |
| ***G03G 15/00*** | (2006.01) |

(52) U.S. Cl.

CPC ..... *G03G 15/04036* (2013.01); *G03G 21/20* (2013.01); *G03G 15/50* (2013.01)

USPC ..... 347/133; 347/261

(58) Field of Classification Search

USPC ..... 347/133, 261

See application file for complete search history.

(56) References Cited

U.S. PATENT DOCUMENTS

| | | | | |
|---|---|---|---|---|
| 2005/0194525 | A1* | 9/2005 | Saka | 250/234 |
| 2006/0066713 | A1* | 3/2006 | Yano | 347/261 |
| 2006/0098216 | A1 | 5/2006 | Sugimoto | |

FOREIGN PATENT DOCUMENTS

| | | | |
|---|---|---|---|
| CN | 1769949 | A | 5/2006 |
| JP | 7-325529 | A | 12/1995 |

(Continued)

OTHER PUBLICATIONS

Office Action (Decision to Grant a Patent) issued on Oct. 29, 2013, by the Japanese Patent Office in corresponding Japanese Patent Application No. 2011-150907, and an English Translation of the Office Action. (6 pages).

(Continued)

*Primary Examiner* — Justin Seo
*Assistant Examiner* — Kendrick Liu
(74) *Attorney, Agent, or Firm* — Buchanan Ingersoll & Rooney PC

(57) ABSTRACT

An image forming apparatus includes a temperature sensor detecting an operating ambient temperature of the polygon motor, and a controller controlling the polygon motor and the paper feed mechanism. If the temperature detected by the temperature sensor is equal to or greater than a preset temperature, the controller controls, before operation for giving a command to start image formation is performed, the polygon motor to rotate; increases, in response to the operation, a rotational speed of the polygon motor up to a rated speed; and controls the paper feed mechanism to start conveying a sheet of paper at a time when a period of time variable depending on the detected temperature has elapsed, the period of time being preset to be shorter as the detected temperature increases, in expectation of a time required for the rotational speed of the polygon motor to reach the rated speed.

10 Claims, 11 Drawing Sheets

(56) References Cited

FOREIGN PATENT DOCUMENTS

| | | | |
|---|---|---|---|
| JP | 09-288248 | A | 11/1997 |
| JP | 3683666 | B2 | 8/1998 |
| JP | 2000-127503 | A | 5/2000 |
| JP | 2001-083451 | A | 3/2001 |
| JP | 2003-341133 | A | 12/2003 |
| JP | 2005-208221 | A | 8/2005 |
| JP | 2005-215174 | A | 8/2005 |
| JP | 2006-133518 | A | 5/2006 |

OTHER PUBLICATIONS

Office Action issued on Aug. 1, 2014, by the Chinese Patent Office in corresponding Chinese Patent Application No. 2012102319224, and an English Translation of the Office Action. (17 pages).

* cited by examiner

FIG. 7

| DETECTED TEMPERATURE T [°C] | PRE-ROTATION TIME X [sec] | CONTROL ON POLYGON MOTOR | PAPER FEED START TIMING (Ta: SET TIME FROM START OPERATION TO PAPER FEED START) | STANDBY ROTATIONAL SPEED | TROUBLE DETECTION TIME (ACCELERATION ALLOWED TIME) [sec] |
|---|---|---|---|---|---|
| T<10 | — | NO PRE-ROTATION, ROTATIONAL SPEED: 0 → RATED SPEED | AFTER DETECTING RATED SPEED ROTATION | — | 20 |
| 10≦T<18 | X<3 | PRE-ROTATION, ROTATIONAL SPEED: 0 → STANDBY → RATED SPEED | Ta= FIXED VALUE + 2 SECONDS | 30000rpm | 7 |
| | 3≦X<4 | | Ta= FIXED VALUE +(5-X) SECONDS | 30000rpm | 7 |
| | 4≦X | | Ta= FIXED VALUE + 1 SECOND | 30000rpm | 7 |
| 18≦T | X<3 | | Ta= FIXED VALUE + 1 SECOND | 27000rpm | 7 |
| | 3≦X<4 | | Ta= FIXED VALUE +(4-X) SECONDS | 27000rpm | 7 |
| | 4≦X | | Ta= FIXED VALUE + 0 SECONDS | 27000rpm | 7 |

IMAGE FORMING APPARATUS AND METHOD FOR CONTROLLING THE IMAGE FORMING APPARATUS

This application is based on Japanese patent application No. 2011-150907 filed on Jul. 7, 2011, the contents of which are hereby incorporated by reference.

BACKGROUND OF THE INVENTION

1. Field of the Invention

The present invention relates to an electrophotographic image forming apparatus in which a polygon motor is used for exposure scanning for forming a latent image, and a method for controlling such an electrophotographic image forming apparatus.

2. Description of the Related Art

A polygon motor having an oil dynamic bearing is widely used as a rotary drive source for a laser scanner. This type of polygon motor has temperature dependence attributable to the viscosity of oil. A start-up time of the polygon motor is significantly longer in the case where an ambient temperature is lower than a predetermined temperature, e.g., in winter, than in the case where the ambient temperature is not lower than the predetermined temperature. The start-up time herein represents the time period from when the polygon motor starts to rotate to when it rotates stably at a speed suitable for exposure operation.

As for control of the start-up of such a polygon motor, the following technology is described in Japanese Laid-open Patent Publication No. 2001-083451. To be specific, in determining that the motor fails for a case where the rotational speed thereof does not reach a target speed even after a predetermined amount of time has elapsed, the predetermined amount of time is extended in the case of low temperatures. Further, another technology is proposed in which, as warm-up operation of a motor at the time of turning the power ON, the motor is rotated at a speed lower than a rotational speed thereof for image formation (Japanese Laid-open Patent Publication No. 2005-215174). Further, another technology is proposed in which, in the case of changing the number of revolutions of a motor, for example, changing it from the number of revolutions under the stand-by state to a first or second number of revolutions at the time of image formation, optical scanning is permitted if a certain time period determined based on the difference between the pre-change and the post-change in number of revolutions has elapsed (Japanese Patent No. 3683666).

Meanwhile, it can be conceived to feed a sheet of paper without stopping the paper from a sheet deck to a position at which a toner image is transferred. The use of such a non-stop paper feed simplifies the structure of the paper feed mechanism and the control thereof, which results in the reduction of the device cost. For the non-stop paper feed, it is necessary to set a paper feed start timing in such a manner that a sheet of paper reaches a transfer position after the state of devices including a polygon motor related to an electrophotographic process is shifted from a standby state to a state suitable for image formation. Assume that the paper feed start timing is set by using, as the reference, an operating ambient temperature under which the start-up time of the polygon motor is longest. In such a case, an inconvenience situation that a sheet of paper reaches the transfer position before the polygon motor starts up completely does not occur. However, in the case of operation under environmental conditions where the start-up time of the polygon motor is relatively short, it takes an excessively long time to completely form an image on the first page since a user gave a command to form images. Such a period of time is referred to as a "first print-out time".

SUMMARY

The present invention has been achieved in light of such an issue, and an object thereof is to provide an image forming apparatus that starts to form an image earlier than is conventionally possible, depending on operating ambient temperature which influences a start-up time of a polygon motor.

An image forming apparatus according to an aspect of the present invention is an image forming apparatus including a polygon motor and a paper feed mechanism, the polygon motor serving to rotate a mirror for deflecting a light beam to expose an image carrier to the light beam, the paper feed mechanism conveying a sheet of paper to a position at which an image developed on the image carrier is transferred, the apparatus including a temperature sensor that detects an operating ambient temperature of the polygon motor; and a controller that controls the polygon motor and the paper feed mechanism depending on a temperature detected by the temperature sensor; wherein if the temperature detected by the temperature sensor is equal to or greater than a preset temperature, the controller controls, before operation for giving a command to start image formation is performed, the polygon motor to rotate at a speed lower than a rated speed that is a rotational speed for latent image formation; increases, in response to the operation, a rotational speed of the polygon motor up to the rated speed; and controls the paper feed mechanism to start conveying a sheet of paper at a time when a period of time variable depending on the detected temperature has elapsed, the period of time being preset to be shorter as the detected temperature increases, in expectation of a time required for the rotational speed of the polygon motor to reach the rated speed, and if the detected temperature is less than the preset temperature, the controller increases, in response to the operation, the rotational speed of the polygon motor, and controls the paper feed mechanism to start conveying the sheet of paper at a time when a preset period of time has elapsed since the rotational speed of the polygon motor reached the rated speed.

These and other characteristics and objects of the present invention will become more apparent by the following descriptions of preferred embodiments with reference to drawings.

BRIEF DESCRIPTION OF THE DRAWINGS

FIG. 7 is a diagram showing control settings depending on an operating ambient temperature of a polygon motor.

DESCRIPTION OF THE PREFERRED EMBODIMENTS

Figure 1:
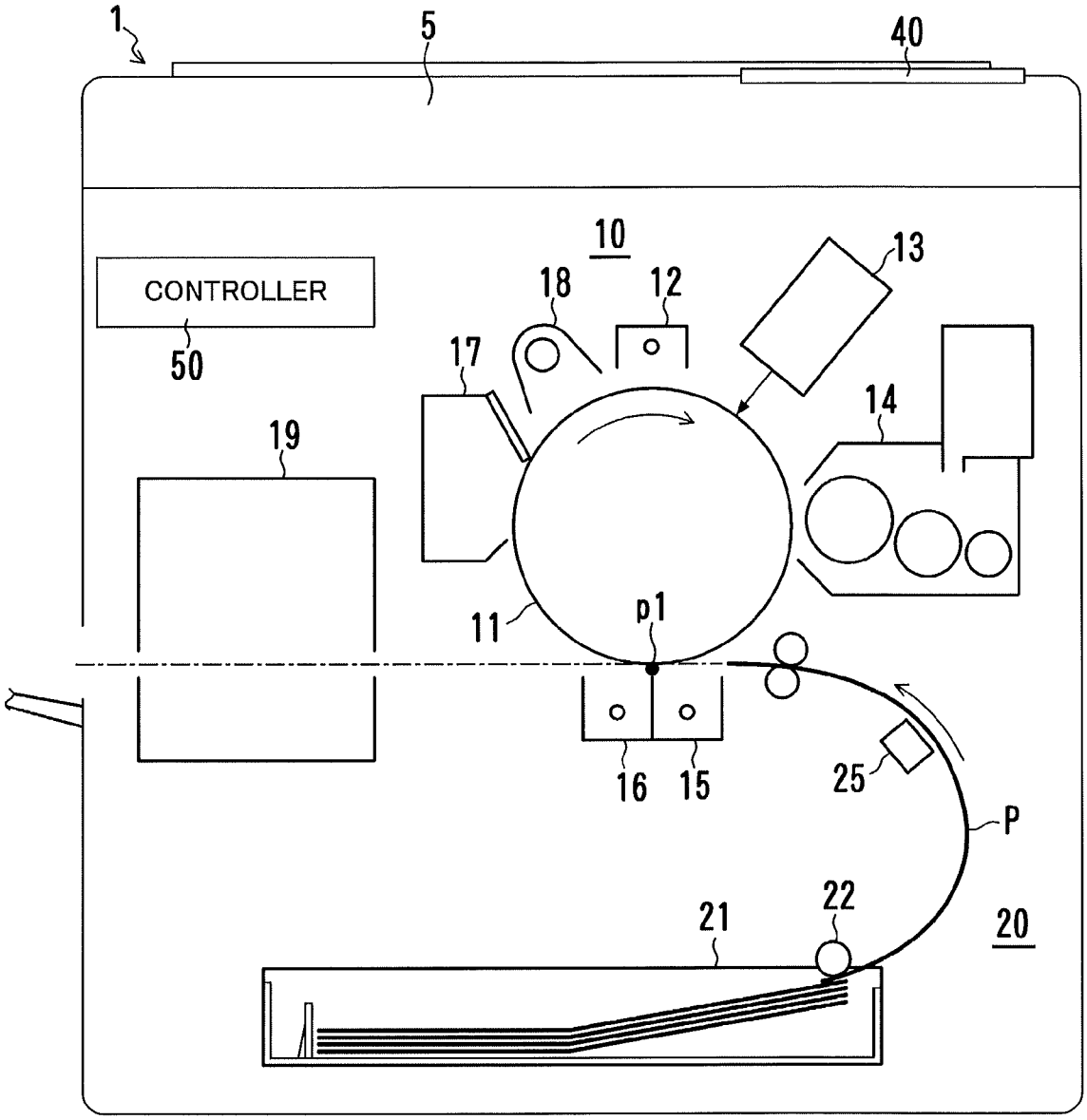
FIG. 1 is a schematic diagram showing an example of the structure of an image forming apparatus.

As shown in FIG. 1, an image forming apparatus 1 is a copier having an image scanner 5. The image forming apparatus 1 may be another device such as a Multi-Functional Peripheral (MFP) or a printer. A printer engine 10 for forming a monochrome image by electrophotography is provided with a photoconductive drum 11 serving as an image carrier, an electrostatic charger 12, a laser scanning unit 13, a developing unit 14, a transfer charger 15, a separation charger 16, a cleaner 17, an erase lamp 18, a fuser 19, and so on. The electrophotographic process using these structural elements for image formation is widely known; therefore the detailed description of the functions of the structural elements and the process thereby shall be omitted.

When an operation is performed on the operating panel 40 to give a command to start image formation, a non-illustrated data processing portion generates, based on a document image read out by the image scanner 5, a raster image to determine an exposure pattern for forming an electrostatic latent image on the photoconductive drum 11. The laser scanning unit 13 performs exposure scanning (also called printing) based on the generated raster image. The exposure scanning is started in such a manner that, at a time when the beginning of an image formation area on a sheet of paper reaches a transfer position p1, a toner image developed on the rotating photoconductive drum 11 also reaches the transfer position p1.

A paper feed mechanism 20 is operable to convey a sheet of paper P, which is supplied from a sheet deck 21 by a pick-up roller 22, to the transfer position p1 at a constant speed without stopping the paper P on its way to the transfer position p1. Stated differently, according to the paper feed in the image forming apparatus 1, commonly-used register control is not performed in which a sheet of paper P is temporarily stopped before the paper P reaches the transfer position p1 and the paper P is advanced synchronously with an image formation timing. The image forming apparatus 1 uses the non-stop paper feed method described earlier, so that the structure of the paper feed mechanism 20 and the control thereof are simplified. A sensor (called TOD sensor) 25 for detecting the paper P is disposed upstream of the transfer position p1 on the paper path. The exposure scanning starts by using, as the reference, a time at which the TOD sensor 25 detects the sheet of paper P.

The photoconductive drum 11 of the printer engine 10 and the pick-up roller 22 of the paper feed mechanism 20 are driven by one main motor (not illustrated). When the main motor rotates, the photoconductive drum 11 rotates with a predetermined rotational speed ratio maintained. The drive force of the main motor is transmitted to the pick-up roller 22 via a clutch. Even if the main motor rotates, the pick-up roller 22 stops provided that the clutch is in an OFF state. When the clutch is switched from OFF to ON during the rotation of the main motor, a sheet of paper P is fed.

Figure 2:
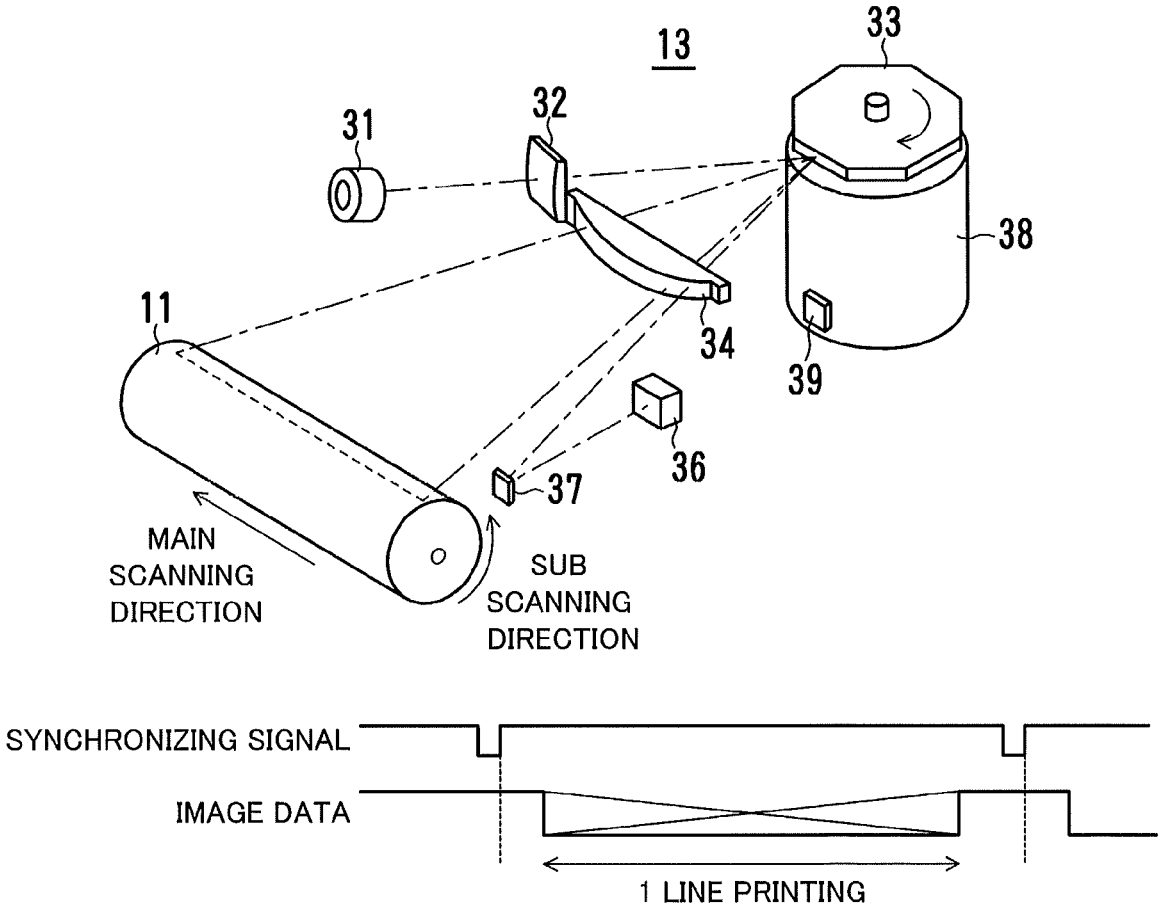
FIG. 2 is a perspective view showing an example of the structure of a laser scanning unit.

In the laser scanning unit 13 shown in FIG. 2, divergent laser lights emitted from a laser diode 31 results in a parallel laser beam by a collimator lens 32. The collimator lens 32 is slightly moved in the forward and backward direction along an optical path, which enables a beam diameter on the photoconductive drum 11 to be adjusted. The laser beam that passed through the collimator lens 32 is deflected by a polygon mirror 33 rotated by a polygon motor 38. The polygon motor 38 of this embodiment is of an oil dynamic type which provides stable and high-speed rotation. The post-deflection laser beam enters the photoconductive drum 11 through a scanning lens 34 for correcting distortion aberration. In order to control a write start position of main scanning onto a photoconductor, a mirror 37 is disposed in the vicinity of one end of the photoconductive drum 11. A laser beam enters the mirror 37 periodically along with the rotation of the polygon mirror 33. The laser beam reflected from the mirror 37 enters a Start of Scanning (SOS) sensor 36. Thereby, a synchronizing signal for the main scanning is obtained.

The laser scanning unit 13 has a temperature sensor 39 for detecting an operating ambient temperature of the polygon motor 38. In this embodiment, the temperature sensor 39 is disposed in the outer surface of the polygon motor 38. With the image forming apparatus 1, a control mode of the polygon motor 38 is changed depending on a temperature detected by the temperature sensor 39. The temperature sensor 39 may be disposed at a position other than the vicinity of the polygon motor 38. For example, the temperature sensor 39 may be disposed in the outer surface of the housing of the image forming apparatus 1 or the vicinity of the outer surface thereof. In such a case, the temperature sensor 39 may detect a temperature perceived by a user or a temperature close thereto as an operating ambient temperature of the polygon motor 38.

Figure 3:
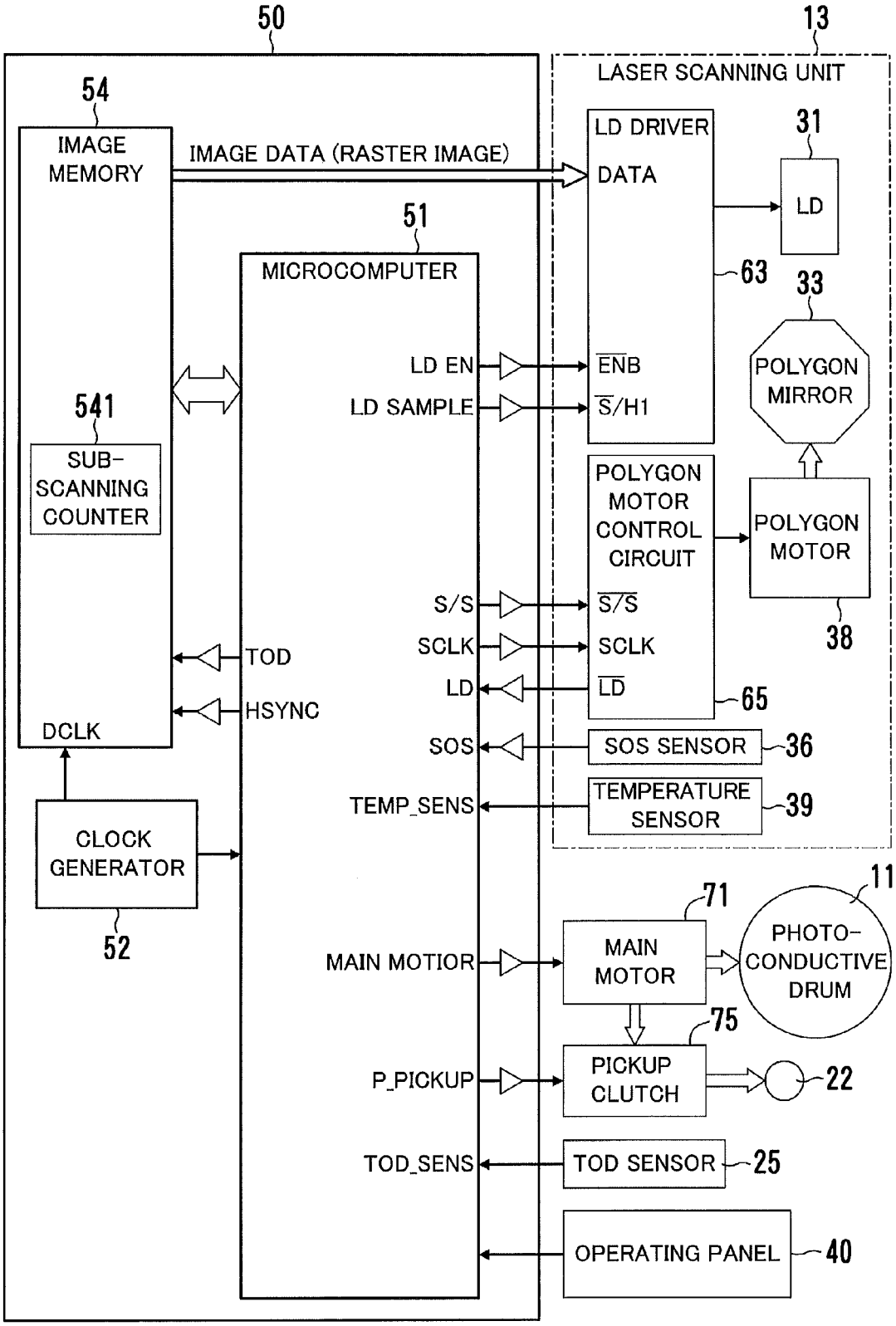
FIG. 3 is a block diagram showing an example of the configuration of a controller.

FIG. 3 shows an example of the configuration of a controller 50 of the image forming apparatus 1. The controller 50 includes a microcomputer 51, a clock generator 52, and an image memory 54. The microcomputer 51 and the image memory 54 operate in accordance with clock signals outputted by the clock generator 52.

The microcomputer 51 converts a photoelectric conversion signal supplied by the SOS sensor 36 into digital form to generate a horizontal synchronizing signal (HSYNC). For doing so, the microcomputer 51 instructs, as necessary, the LD driver 63 to cause the laser diode (LD) 31 to emit a light compulsorily.

The microcomputer 51 supplies, to a polygon motor control circuit 65, a Start/Stop signal (hereinafter referred to as an S/S signal) and an SCLK signal that is a square wave signal having a frequency depending on a target rotational speed. The polygon motor control circuit 65 controls the rotation of the polygon motor 38. When the rotational speed of the polygon motor 38 reaches the target speed under the control of the polygon motor control circuit 65, an LD signal supplied from the polygon motor control circuit 65 to the microcomputer 51 becomes active. The microcomputer 51 receives an input of a detection signal from the temperature sensor 39 in order to instruct a rotation control depending on the operating ambient temperature.

The microcomputer 51 serves to control ON/OFF of the main motor 71 which drives the photoconductive drum 11 and other loads, and to control the clutch 75 which transmits the drive force to the pick-up roller 22. The microcomputer 51 receives an input of a detection signal from the TOD sensor 25 in order that printing is started at an appropriate time after paper feed starts.

The microcomputer 51 outputs a horizontal synchronizing signal (HSYNC) and an image request signal (TOD) to the image memory 54. The TOD signal triggers a sub-scanning counter 541 of the image memory 54 to start counting HSYNC. The image memory 54 then outputs image data of lines depending on the count value to the LD driver 63.

Figure 4:
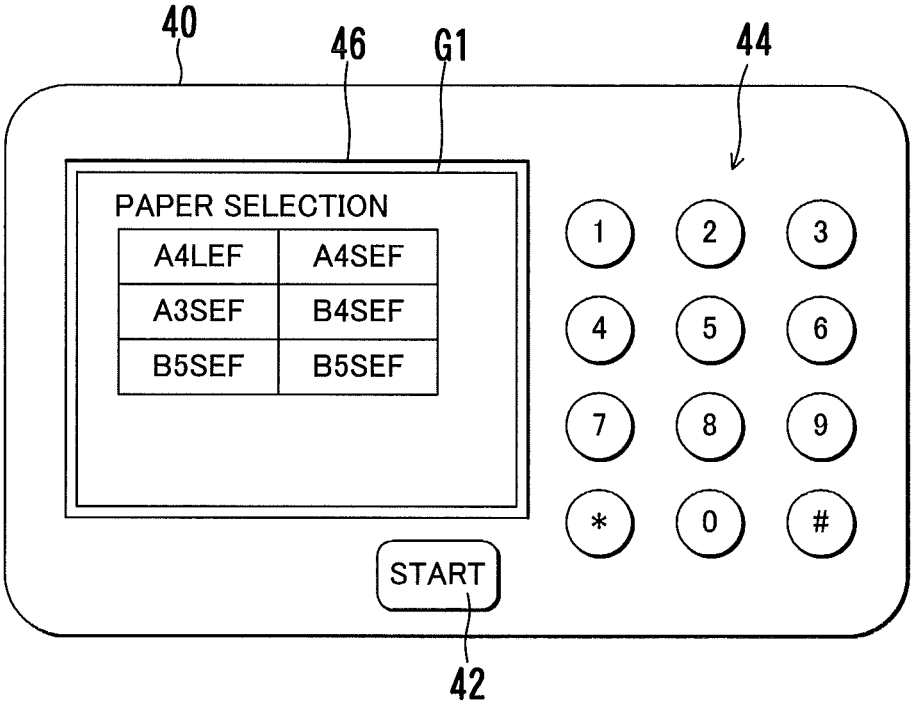
FIG. 4 is a diagram showing an example of the structure of an operating panel.

The microcomputer 51 receives an input of a signal from the operating panel 40, and controls the structural elements for image formation of the printer engine 10 shown in FIG. 1 to form an image designated by a user. As shown in FIG. 4, the operating panel 40 includes a copy button 42 through which image formation is instructed, numeric keys 44 used for setting the number of copies, and a touch-sensitive panel 46 for various displays. In the illustrated example, the touch-sensitive panel 46 displays, thereon, an operating screen G1 for paper selection.

When some sort of operation is made before the copy button 42 is pressed, an output from the operating panel 40 is supplied to the microcomputer 51 as a normal operation signal indicating the details of the operation, and at the same time, as a command to pre-rotate the polygon motor 38. At this time, the microcomputer 51 performs operational settings and changes indications on the display in accordance with the operation made on the operating panel 40, and also starts a standby rotation of the polygon motor 38 if a pre-rotation mode is entered. To be specific, the microcomputer 51 causes the polygon motor 38 to rotate ahead of time at a standby rotational speed (27000-30000 rpm, for example) lower than a rated speed (35000 rpm, for example) which is a rotational speed for the case of image formation. This makes it possible to form an image as quickly as possible after the copy button 42 is pressed. The pre-rotation operation is provided based on the assumption that a user who has performed some sort of operation is to press the copy button 42 early after the operation. However, if the pre-rotation mode is not entered, the pre-rotation command is invalid.

In this embodiment, operation other than the operation of pressing the copy button 42 triggers the pre-rotation of the polygon motor 38. Instead of this, when the image forming apparatus 1 is provided with a sensor for detecting that a user approaches the image forming apparatus 1, detection of the approach of the user may trigger the pre-rotation of the polygon motor 38. Alternatively, logon operation by reading out an IC card or through biometric identity verification may trigger the pre-rotation. In essence, the pre-rotation may be performed when it is expected that a command to start image formation is entered shortly.

Figure 5:
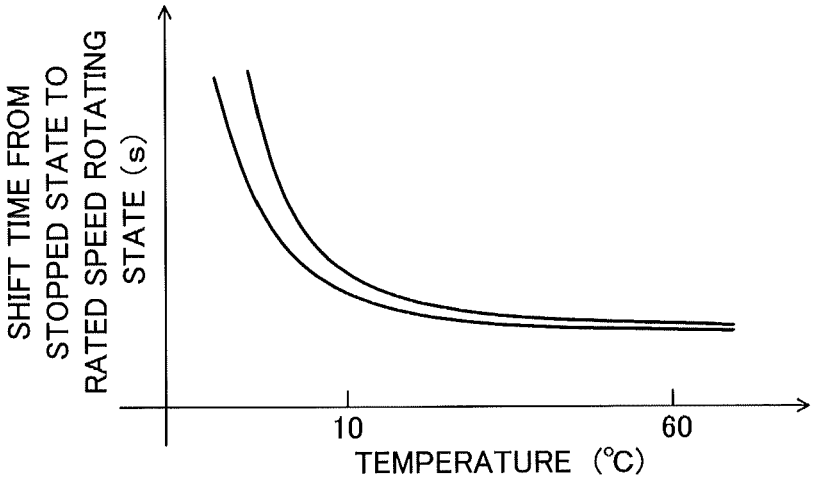
FIG. 5 is a graph showing temperature dependence of a polygon motor relating to a time required for the polygon motor to accelerate and enter a rotating state at a rated speed from a stopped state.
Figure 6:
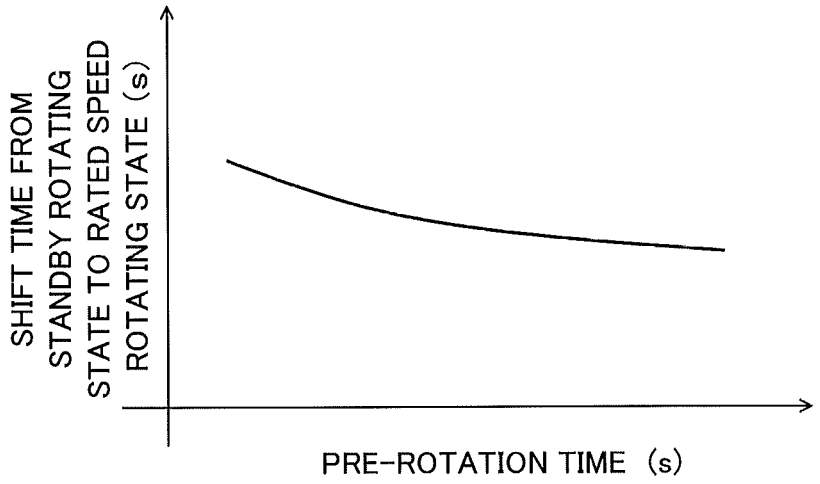
FIG. 6 is a graph showing the relationship between a pre-rotation time and a time required for a polygon motor to accelerate and enter a rotating state at a rated speed from a pre-rotating state at a standby rotational speed.

FIGS. 5 and 6 are graphs showing the characteristics relating to a start-up of an oil dynamic type polygon motor. As shown in FIG. 5, the time required for the polygon motor to accelerate and enter a rotating state at a rated speed from a stopped state depends on temperature. Due to the properties of oil that is a bearing working fluid, the time required for the acceleration of the polygon motor tends to be excessively longer at a temperature of approximately 10° C. or less, as compared to the case where a temperature is greater than 10° C. Further, the difference between an oil dynamic type polygon motor and another polygon motor of the same type in the required time tends to be wider at a temperature of approximately 10° C. or less, as compared to the case where a temperature is greater than 10° C. Variation of the required time in an oil dynamic type polygon motor with time also tends to be wider at a temperature of approximately 10° C. or less, as compared to the case where a temperature is greater than 10° C. In contrast, as shown in FIG. 6, the time required for the oil dynamic type polygon motor to accelerate and reach a rated speed from a standby rotational speed tends to be shorter as the pre-rotation time before the acceleration is longer. This is because the oil dynamic type polygon motor evolves heat by its rotation during the pre-rotation period, and the oil is warmed by the heat.

The following is a further detailed description of control (start-up control) operation for turning the image forming apparatus 1 from a non-operating state under which the polygon motor 38 stops to a state under which an image can be formed.

FIG. 7 shows settings for control depending on the operating ambient temperature of the polygon motor 38. According to the image forming apparatus 1 of this embodiment, the control mode is changed from one to another as shown in FIG. 7 depending on the operating ambient temperature of the polygon motor 38. The image forming apparatus 1 has roughly two control modes. One of the modes is applied for the case where a temperature detected by the temperature sensor 39 is less than 10° C. The other is applied for the case where a temperature detected by the temperature sensor 39 is 10° C. or greater. Note, however, that the preset temperature based on which the control modes are classified is not limited to 10° C. The preset temperature may be appropriately selected depending on the temperature characteristics relating to the start-up of the polygon motor 38.

When the detected temperature by the temperature sensor 39 is less than 10° C. (referred to as a "low temperature" for the sake of convenience), the pre-rotation of the polygon motor 38 is not performed. As discussed above with reference to FIG. 5, the time required for acceleration of the polygon motor is long for the case of low temperatures. Thus, the copy button 42 is pressed usually before the rotational speed of the polygon motor 38 reaches a standby rotational speed. In such a case, there is not much difference in time required for the rotational speed of the polygon motor 38 to reach a rated speed between the following two cases: (1) A case where the pre-rotation for accelerating the polygon motor 38 from a speed of zero to a standby rotational speed is started, and then the polygon motor 38 is further accelerated to reach a rated speed in response to the copy button 42 pressed; and (2) A case where, without the pre-rotation of the polygon motor 38, the rotational speed of the polygon motor 38 is increased from a speed of zero to a rated speed in response to the copy button 42 pressed. Thus, the pre-rotation is not performed for the case of low temperatures in order to avoid making an unnecessary rotational noise of the polygon motor 38.

When the detected temperature by the temperature sensor 39 is less than 10° C. (low temperature), an acceleration allowed time (trouble detection time) from when the polygon motor 38 starts to accelerate until when the rotational speed thereof reaches the target speed is set to be relatively longer. The illustrated acceleration allowed time is set at 20 seconds. When the target speed is not reached after the elapse of the acceleration allowed time from the start of acceleration, the image formation is stopped assuming that any sort of troubles occur in the polygon motor 38 or the driving circuit.

When the detected temperature by the temperature sensor 39 is 10° C. or greater (referred to as a "medium and high temperature" for the sake of convenience), the pre-rotation of the polygon motor 38 is performed, and the acceleration allowed time is set to be shorter than that for the case of low temperature. The illustrated acceleration allowed time is set at 7 seconds. Further, the temperature range for the medium and high temperature is classified into a range of not less than 10° C. and less than 18° C. (referred to as a "medium temperature" for the sake of convenience) and a range of 18° C. or greater (referred to as a "high temperature" for the sake of convenience). Moreover, each of the medium temperature range and the high temperature range is divided into three cases depending on the length of a pre-rotation time X. A paper feed start timing is determined for each of the total six cases. The pre-rotation time X is defined as the time period from when the polygon motor 38 starts rotating and rotates at a standby rotational speed to when the polygon motor 38 starts acceleration from the standby rotational speed to a rated speed (see FIG. 8 described later). The controller 50 measures the pre-rotation time X.

The standby rotational speed that is the target speed for pre-rotation is different between the case of medium temperature and the case of high temperature. The standby rotational speed is 30000 rpm for the case where the detected temperature corresponds to the medium temperature. The standby rotational speed is 27000 rpm for the case where the detected temperature corresponds to the high temperature. The higher the temperature is, the shorter the acceleration time required for the rotational speed of the polygon motor 38 to reach the rated speed from the standby rotational speed is. Thus, even if the standby rotational speed is reduced, the rotational speed of the polygon motor 38 can reach a rated speed within a period of time during which other devices around the photoconductor start up. Lower rotational speed of the polygon motor 38 is advantageous considering the reduction in noise of the image forming apparatus 1.

A paper feed waiting time Ta relating to the paper feed start timing, specifically, a time period from when the copy button 42 is pressed (start command) to when the pickup clutch 75 is turned ON, is variable because the paper feed waiting time Ta is determined by adding an extra time to a predetermined fixed time. To be specific, the longer the pre-rotation time X is, the shorter the extra time is added to the predetermined fixed time. Assume that, for example, the detected temperature corresponds to the medium temperature. If the pre-rotation time X is shorter than 3 seconds, then the extra time is 2 seconds. If the pre-rotation time X is not less than 3 seconds and less than 4 seconds, then the extra time is (5−X) seconds. If the pre-rotation time X is equal to or longer than 4 seconds, then the extra time is 1 second. Assume that, for example, the detected temperature corresponds to the high temperature. If the pre-rotation time X is shorter than 3 seconds, then the extra time is 1 second. If the pre-rotation time X is not less than 3 seconds and less than 4 seconds, then the extra time is (4−X) seconds. If the pre-rotation time X is equal to or longer than 4 seconds, then the extra time is zero seconds.

Referring to FIG. 7, settings are basically made in such a manner that, the higher the temperature is, the shorter the paper feed waiting time Ta is. This is apparent from the comparison between an extra time for medium temperature and an extra time for high temperature. This is because the higher the temperature is, the earlier the polygon motor 38 is expected to enter a rated speed state. Thus, the paper feed waiting time Ta, which is a set time to wait for a sheet of paper to be fed after the polygon motor 38 enters a state suitable for image formation, is set to be variable. Such setting is effective in forming an image correctly by using the non-stop paper feed mechanism 20 in which no register control is performed. Such setting is also effective in expediting image formation under high temperatures. If the paper feed waiting time Ta has a fixed value, in other words, if paper feed is started at a uniform time independently of temperature, then, it is necessary to determine a paper feed time with reference to a long start-up time for the case of low temperature in order to form an image correctly even under a low temperature.

Figure 8:
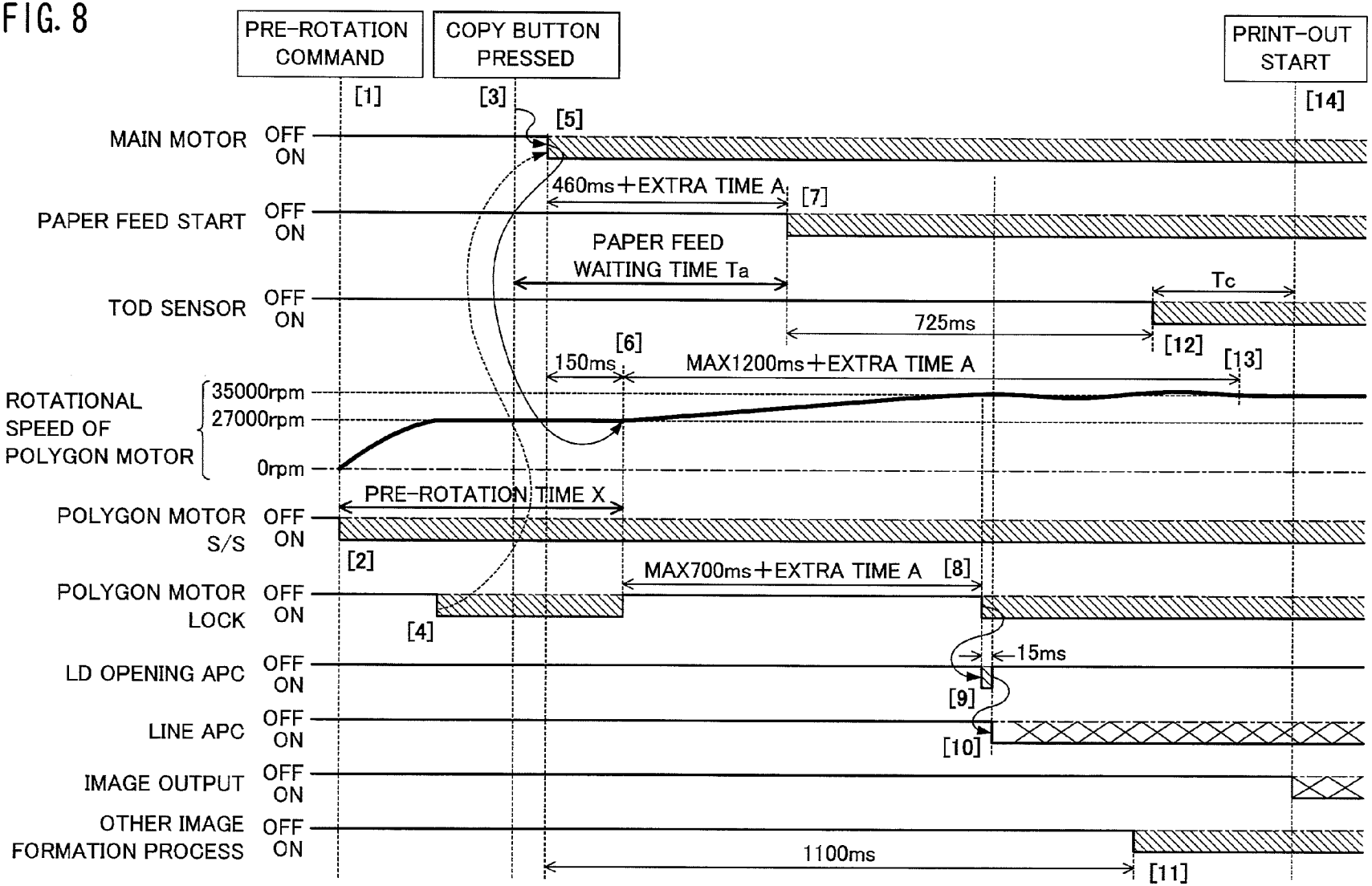
FIG. 8 is an operation timing chart for a case where an operating ambient temperature of a polygon motor is a preset temperature or higher.

FIG. 8 is an operation timing chart for a case where an operating ambient temperature of the polygon motor 38 corresponds to a medium and high temperature greater than a preset temperature.

When receiving the pre-rotation command mentioned above [1], the controller 50 turns an S/S signal ON [2] to rotate the polygon motor 38 that is in a stopped state. At this time, the target speed is a standby rotational speed. In response to the S/S signal turned ON, a timer for pre-rotation time X starts counting. Thereafter, when the copy button 42 is pressed [3], after a predetermined amount of time (approximately several tens of milliseconds) has elapsed, the controller 50 confirms [4] that a Lock signal, which indicates that the rotational speed of the polygon motor 38 reaches the target speed, is active (turned ON), and turns the main motor 71 ON [5]. One hundred and fifty milliseconds after the main motor 24 is turned ON, the controller 50 increases [6] the rotational speed of the polygon motor 38 from the standby rotational speed to the rated speed. Stated differently, starting up the main motor 71 and accelerating the polygon motor 38 are performed at different times to avoid imposing an excess load on the power source. The timer for pre-rotation time X finishes counting at a time when the rotational speed of the polygon motor 38 is increased from the standby rotational speed to the rated speed. The extra time A of the paper feed waiting time Ta is determined in accordance with the settings shown in FIG. 7 depending on the value of the pre-rotation time X and the detected temperature by the temperature sensor 39.

At a time when the paper feed waiting time Ta, which corresponds to the combined length of a fixed time of 460 milliseconds and the extra time A, has elapsed since the main motor 71 was turned ON [7], the controller 50 turns the pickup clutch 75 ON, and rotates the pick-up roller 22. Thereby, paper feed starts. After 725 milliseconds have elapsed since the paper feed started, the TOD sensor 25 detects a sheet of paper P [12]. The paper detection by the TOD sensor 25 triggers the sub-scanning counter 541 of the image memory 54 to start counting. At a time when a preset time Tc, which is determined based on the paper feed speed and a distance between the leading edge of the paper P and the beginning of image formation position on the paper P, has elapsed, the image memory 54 starts outputting image data to the LD driver 63, and the laser scanning unit 13 starts printing (exposure scanning onto the photoconductor) [14].

During a period between the start of paper feed and the start of printing, a Lock signal, which indicates that the rotational speed of the polygon motor 38 reaches the target rated speed, is turned ON again until an elapsed time reaches a time obtained by adding the extra time A to at longest 700 milliseconds usually since the polygon motor 38 was accelerated to reach the rated speed. When confirming that the Lock signal is turned ON [8], the controller 50 controls the LD driver 63 [9] to perform, for 15 milliseconds, an opening Auto Power Control (APC) in which an output of the laser diode 31 is so adjusted that an output of the SOS sensor 36 has a preset level. Following the opening APC, a line APC starts [10] to adjust the amount of light for main scanning in synchronism with the output of the SOS sensor 36. At this time, the laser scanning unit 13 enters a print start permission state under which image data can be inputted.

The polygon motor 38 enters a print start permission state under which the rotation thereof is stable [13] until an elapsed time reaches a time obtained by adding the extra time A to at longest 1200 milliseconds since the polygon motor 38 started to accelerate from the standby rotational speed to the rated speed. The polygon motor 38 enters the print start permission state before measuring the time Tc is finished. The devices that are provided in the periphery of the photoconductive drum 11 and operable to perform an image formation process except for exposure scanning enter the print start permission state 1100 milliseconds after the main motor 71 is turned ON. This happens also before measuring the time Tc is finished.

Figure 9:
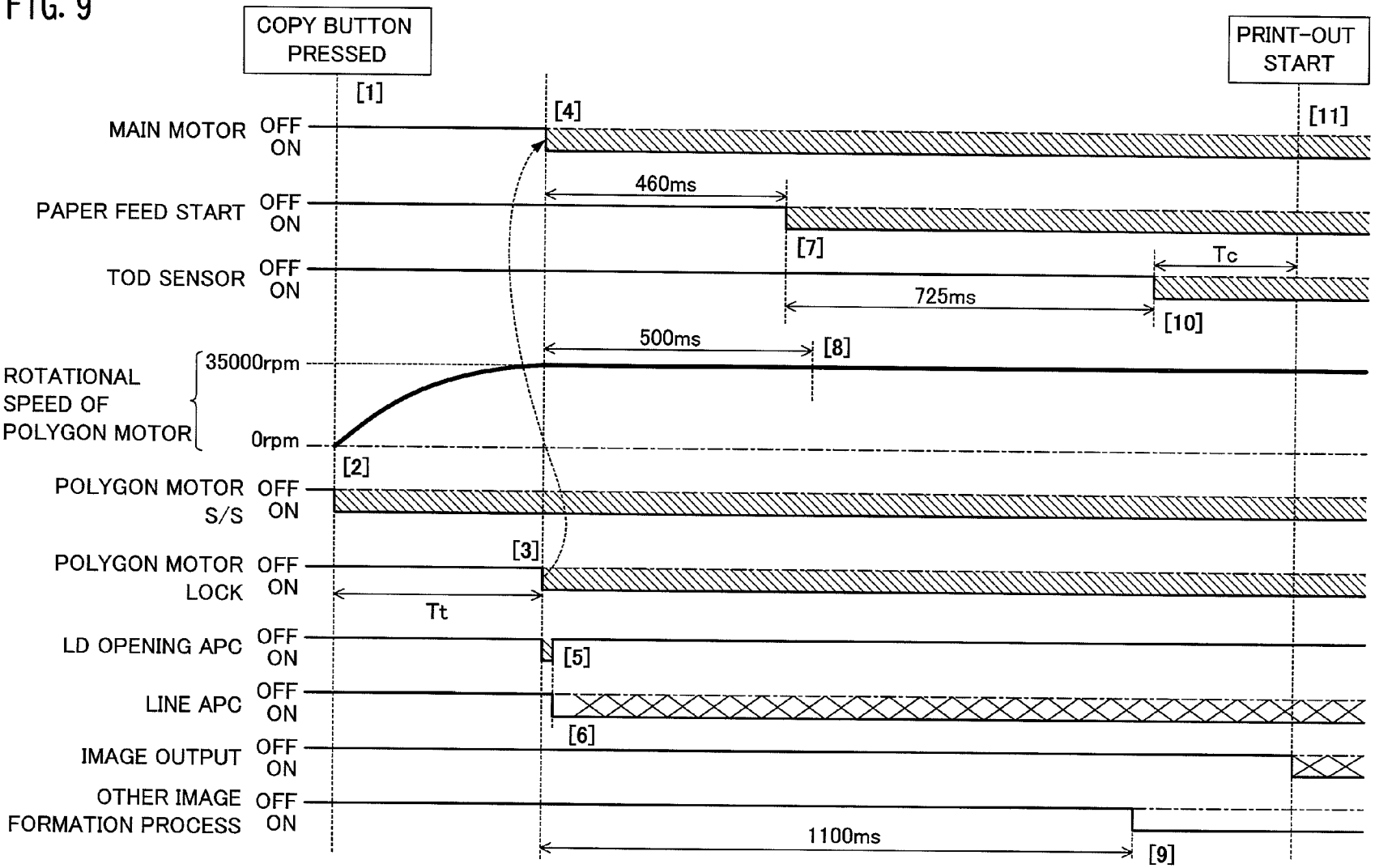
FIG. 9 is an operation timing chart for a case where an operating ambient temperature of a polygon motor is less than a preset temperature.

FIG. 9 is an operation timing chart for a case where an operating ambient temperature of the polygon motor 38 corresponds to a low temperature less than a preset temperature.

As discussed earlier, no pre-rotation is performed for the case of low temperatures. When the copy button 42 is pressed [1], the controller 50 starts up the polygon motor 38 [2], confirms that a Lock signal, which indicates that the rotational speed of the polygon motor 38 reaches the target rated speed, is turned ON [3], and turns the main motor 71 ON [4]. If a period of time Tt between the start-up of the polygon motor 38 and the Lock signal turned ON is longer than the acceleration allowed time (trouble detection time), an indication is made to inform a user of the occurrence of a trouble. The polygon motor 38 enters a completely stable rotating state (print start permission state) [8] 500 milliseconds after the Lock signal is turned ON.

At a time when 460 milliseconds have elapsed since the main motor 71 was turned ON, the controller 50 turns the pickup clutch 75 ON, and rotates the pick-up roller 22 [7]. Thereby, paper feed starts. After 725 milliseconds have elapsed since the paper feed started, the TOD sensor 25 detects a sheet of paper P [10]. The paper detection by the TOD sensor 25 triggers the sub-scanning counter 541 of the image memory 54 to start counting. At a time when the preset time Tc has elapsed, the image memory 54 starts outputting image data to the LD driver 63, and the laser scanning unit 13 starts printing (exposure onto the photoconductor) [11].

When conforming that the Lock signal is turned ON [3], the controller 50 controls the LD driver 63 [5] to perform the opening APC for 15 milliseconds. Following the opening APC, the line APC starts [6]. At this time, the laser scanning unit 13 enters the print start permission state. The devices that are provided in the periphery of the photoconductive drum 11 and operable to perform an image formation process except for exposure enter the print start permission state [9] 1100 milliseconds after the main motor 71 is turned ON. This happens before measuring the time Tc is finished.

The start-up time of the polygon motor 38 is long for the case of low temperatures. Therefore, if the main motor 71 is turned ON before the rotational speed of the polygon motor 38 reaches the rated speed, the photoconductive drum 11 rotates unnecessarily for a long time, which hastens the deterioration of the photoconductor. In this embodiment, the main motor 71 is turned ON after the Lock signal is turned ON, which avoids shortening the life of the photoconductor.

Figure 10:
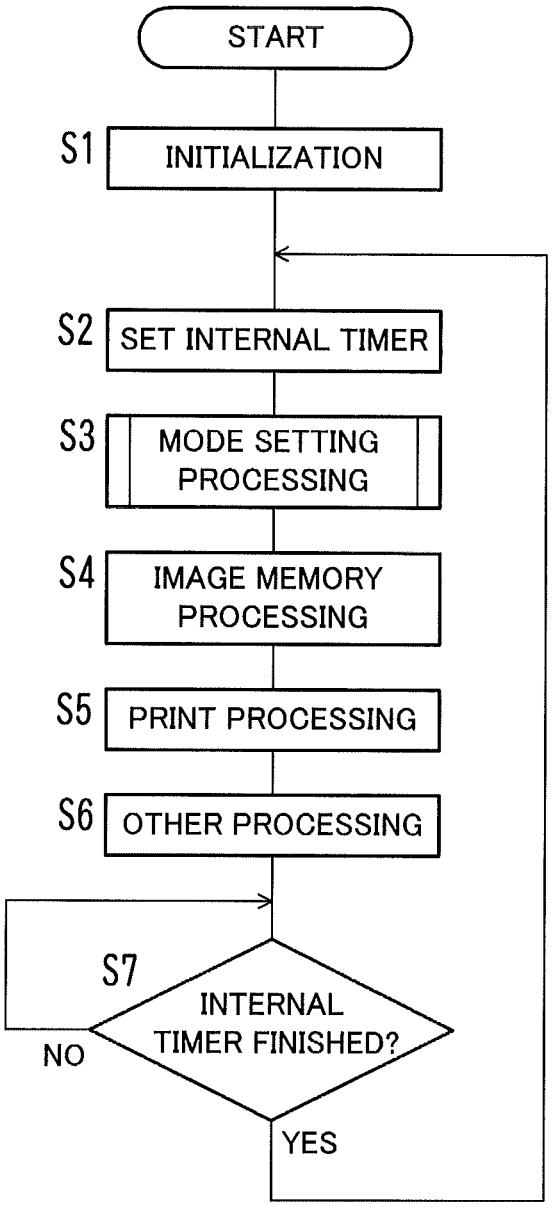
FIG. 10 is a flowchart depicting an example as to how to control by a controller.

FIG. 10 is a flowchart depicting an example of control by the controller 50. When the power is turned ON, or, alternatively, when reset operation is performed, the microcomputer 51 initializes a work area for program execution and a timer (Step S1), an internal timer for defining the length of one routine is set (Step S2). The following processes are performed in the stated order: mode setting processing for control in accordance with the operating environment of the polygon motor 38 (Step S3); image data processing for generating a raster image for printing (Step S4); print processing for controlling the printer engine 10 and the paper feed mechanism 20 (Step S5); and other processing such as receiving operation and making an indication (Step S6). Then, after the internal timer finishes counting, the processing by the microcomputer 51 returns to Step S2 (Step S7), and executes the processing from Step S2 through Step S7 repeatedly.

Figure 11:
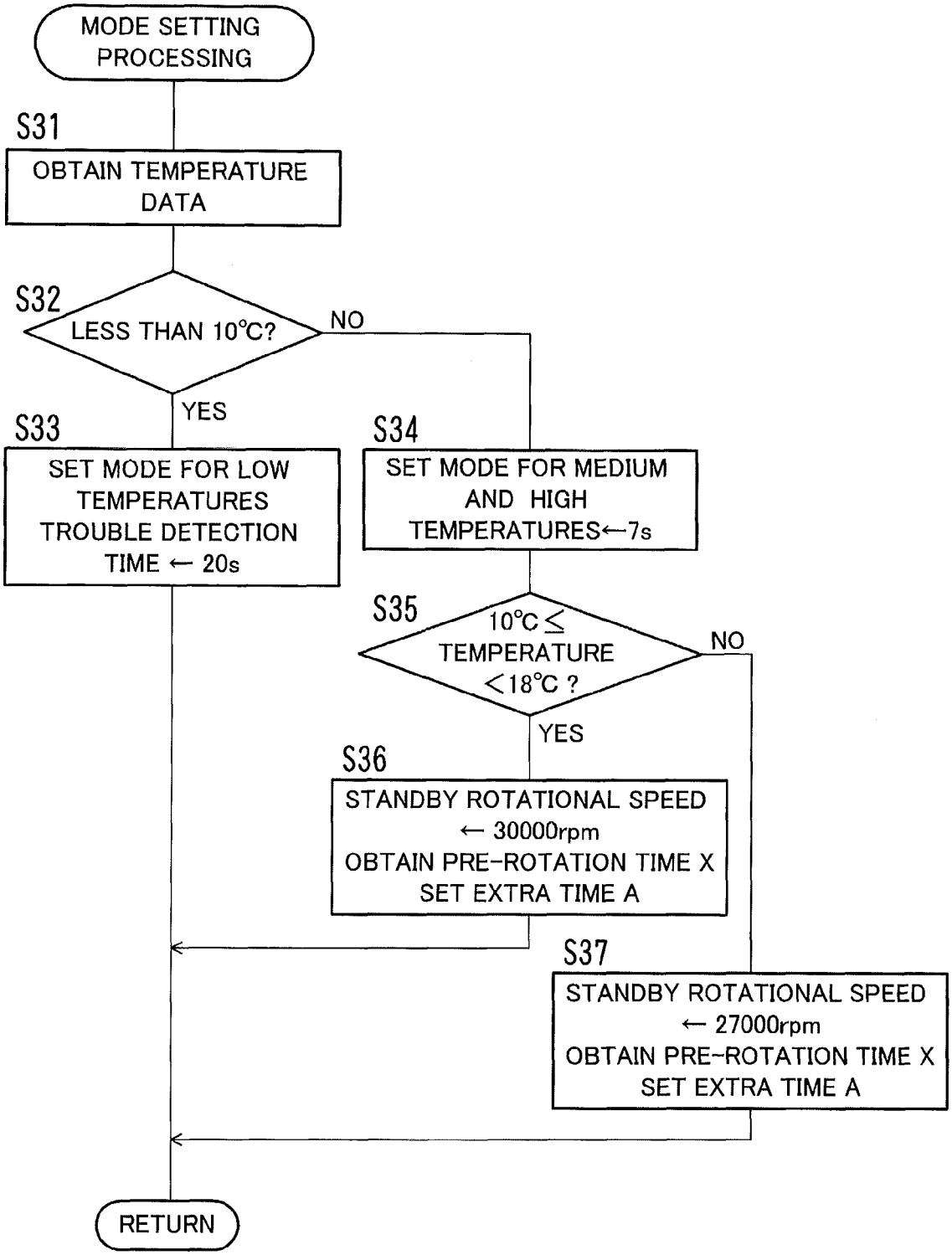
FIG. 11 is a flowchart depicting an example of a mode setting processing subroutine.

FIG. 11 is a flowchart depicting an example of a mode setting processing subroutine. The microcomputer 51 obtains, from the temperature sensor 39, temperature data indicating an operating ambient temperature of the polygon motor 38 (Step S31). If the operating ambient temperature is less than 10° C. (Yes in Step S32), then the control mode is set at a mode for low temperatures, and a trouble detection time (acceleration allowed time) Tt is set at 20 seconds (Step S33). If the operating ambient temperature is not less than 10° C. (No in Step S32), then the control mode is set at a mode for medium and high temperatures, and the trouble detection time Tt is set at 7 seconds (Step S34). If the operating ambient temperature is not less than 10° C. and less than 18° C. (Yes in Step S35), then the microcomputer 51 sets the standby rotational speed at 30000 rpm, obtains the measured value of the pre-rotation time X, and determines an extra time A for the paper feed waiting time Ta (Step S36). If the operating ambient temperature is equal to or greater than 18° C. (No in Step S35), then the microcomputer 51 sets the standby rotational speed at 27000 rpm, obtains the measured value of the pre-rotation time X, and determines an extra time A for the paper feed waiting time Ta (Step S37).

According to the foregoing embodiment, in the image forming apparatus 1 using the paper feed mechanism 20 by which conveying a sheet of paper P is not stopped from the start of paper feed to, at least, the transfer of a toner image, printing (exposure scanning) can be started early depending on the temperature characteristics relating to the start-up of the polygon motor 38. This shortens the first print-out time under temperatures except for low temperature. Stated differently, according to the foregoing embodiment, it is possible to provide an image forming apparatus that starts to form an image earlier than is conventionally possible, depending on operating ambient temperature which influences a start-up time of a polygon motor.

In the foregoing embodiment, the configuration of the image forming apparatus 1 can be appropriately modified without departing from the spirit of the present invention. The standby rotational speed, the rated speed, the preset temperature for each control mode, time relating to the sequences, and so on are not limited to the exemplified cases, and may be selected depending on the specifications of the polygon motor 38 or the speed of the electrophotographic processing system. The printer engine 10 may be a type capable of forming color images. The image forming apparatus 1 may be a printer without an image scanner. In a printer having a function to print out a document stored in a built-in memory, pre-rotation can be performed in response to operation other than print start operation. When an image is formed in response to, for example, an input of a print job from an external personal computer rather than to direct operation on the operating panel 40, checking the state of the printer or other accesses may be regarded as the pre-rotation command.

While example embodiments of the present invention have been shown and described, it will be understood that the present invention is not limited thereto, and that various changes and modifications may be made by those skilled in the art without departing from the scope of the invention as set forth in the appended claims and their equivalents.

What is claimed is:

1. An image forming apparatus including a polygon motor and a paper feed mechanism, the polygon motor serving to rotate a mirror for deflecting a light beam to expose an image carrier to the light beam, the paper feed mechanism conveying a sheet of paper to a position at which an image developed on the image carrier is transferred, the apparatus comprising:

a temperature sensor that detects an operating ambient temperature of the polygon motor; and a controller that controls the polygon motor and the paper feed mechanism depending on a temperature detected by the temperature sensor; wherein if the temperature detected by the temperature sensor is equal to or greater than a preset temperature, the controller controls, before operation for giving a command to start image formation is performed, the polygon motor to rotate at a speed lower than a rated speed that is a rotational speed for latent image formation; increases, in response to the operation, a rotational speed of the polygon motor up to the rated speed; and controls the paper feed mechanism to start conveying a sheet of paper at a time when a period of time variable depending on the detected temperature has elapsed, the period of time being preset to be shorter as the detected temperature increases, in expectation of a time required for the rotational speed of the polygon motor to reach the rated speed, and if the detected temperature is less than the preset temperature, the controller increases, in response to the operation, the rotational speed of the polygon motor, and controls the paper feed mechanism to start conveying the sheet of paper at a time when a preset period of time has elapsed since the rotational speed of the polygon motor reached the rated speed.

2. The image forming apparatus according to claim 1, wherein, if the detected temperature is less than the preset temperature, the controller controls the polygon motor to stop until the operation is performed.

3. The image forming apparatus according to claim 1, wherein, for each temperature range obtained from classification of temperatures not less than the preset temperature, the rotational speed of the polygon motor before the operation is so set that the rotational speed of the polygon motor becomes lower as the detected temperature increases.

4. The image forming apparatus according to claim 1, wherein, if the detected temperature is equal to or greater than the preset temperature, the controller measures an elapsed time from when the polygon motor starts rotating before the operation to when the operation is performed, and a time period from when the operation is performed to when the paper feed mechanism starts conveying a sheet of paper is set to be shorter as a length of the elapsed time measured increases.

5. The image forming apparatus according to claim 1, wherein an allowed time from when the polygon motor starts rotating to when the rotational speed of the polygon motor reaches a target speed is preset in order to detect an error in the polygon motor, and the allowed time is longer in a case where the detected temperature is less than the preset temperature than in a case where the detected temperature is equal to or greater than the preset temperature.

6. A method for controlling an image forming apparatus including a polygon motor and a paper feed mechanism, the polygon motor serving to rotate a mirror for deflecting a light beam to expose an image carrier to the light beam, the paper feed mechanism conveying a sheet of paper to a position at which an image developed on the image carrier is transferred, the method comprising:

detecting an operating ambient temperature of the polygon motor;

if the temperature detected is equal to or greater than a preset temperature, rotating, before operation for giving a command to start image formation is performed, the polygon motor at a speed lower than a rated speed that is a rotational speed for latent image formation, increasing, in response to the operation, a rotational speed of the polygon motor up to the rated speed, and controlling the paper feed mechanism to start conveying a sheet of paper at a time when a period of time variable depending on the detected temperature has elapsed, the period of time being preset to be shorter as the detected temperature increases, in expectation of a time required for the rotational speed of the polygon motor to reach the rated speed; and if the detected temperature is less than the preset temperature, increasing the rotational speed of the polygon motor in response to the operation, and controlling the paper feed mechanism to start conveying the sheet of paper at a time when a preset period of time has elapsed since the rotational speed of the polygon motor reached the rated speed.

7. The method according to claim 6, wherein, if the detected temperature is less than the preset temperature, the polygon motor is controlled to stop until the operation is performed.

8. The method according to claim 6, wherein, for each temperature range obtained from classification of temperatures not less than the preset temperature, the rotational speed of the polygon motor before the operation is so set that the rotational speed of the polygon motor becomes lower as the detected temperature increases.

9. The method according to claim 6, comprising, if the detected temperature is equal to or greater than the preset temperature, measuring an elapsed time from when the polygon motor starts rotating before the operation to when the operation is performed, and setting a time period from when the operation is performed to when the paper feed mechanism starts conveying a sheet of paper to be shorter as a length of the elapsed time measured increases.

10. The method according to claim 6, wherein an allowed time from when the polygon motor starts rotating to when the rotational speed of the polygon motor reaches a target speed is preset in order to detect an error in the polygon motor, and the allowed time is longer in a case where the detected temperature is less than the preset temperature than in a case where the detected temperature is equal to or greater than the preset temperature.

* * * * *